US010512818B2

(12) United States Patent
Powell

(10) Patent No.: US 10,512,818 B2
(45) Date of Patent: Dec. 24, 2019

(54) PORTABLE COMPACT CYCLING TRAINER

(71) Applicant: Peter George Domique Powell, Farmington, CT (US)

(72) Inventor: Peter George Domique Powell, Farmington, CT (US)

( * ) Notice: Subject to any disclaimer, the term of this patent is extended or adjusted under 35 U.S.C. 154(b) by 35 days.

(21) Appl. No.: 16/008,854

(22) Filed: Jun. 14, 2018

(65) Prior Publication Data

US 2018/0369635 A1 Dec. 27, 2018

Related U.S. Application Data

(60) Provisional application No. 62/523,501, filed on Jun. 22, 2017.

(51) Int. Cl.
*A63B 22/06* (2006.01)
*A63B 71/00* (2006.01)

(52) U.S. Cl.
CPC ..... *A63B 22/0694* (2013.01); *A63B 71/0036* (2013.01); *A63B 22/0605* (2013.01); *A63B 2210/50* (2013.01)

(58) Field of Classification Search
CPC ..... A63B 22/0605; A63B 22/0694; A63B 71/0036; A63B 2210/50
See application file for complete search history.

(56) References Cited

U.S. PATENT DOCUMENTS 3,259,385 A 6/1966 Boren
3,622,153 A 11/1971 Thompson
3,751,033 A 8/1973 Rosenthal
4,632,386 A * 12/1986 Beech ..... A63B 22/0605 248/649
4,700,942 A * 10/1987 Danchulis ..... A63B 22/0605 180/276
4,720,094 A * 1/1988 Danchulis ..... A63B 22/0605 403/347
4,805,901 A * 2/1989 Kulick ..... A63B 22/0605 297/118
4,973,046 A * 11/1990 Maxwell ..... A63B 21/00178 482/60
5,071,117 A 12/1991 Mautner
5,314,392 A * 5/1994 Hawkins ..... A63B 22/0056 482/52
5,372,562 A * 12/1994 Chang ..... B62M 3/003 482/57
5,618,247 A * 4/1997 Perez ..... A63B 21/1645 482/60
7,527,581 B1 5/2009 Verost
8,795,141 B2 8/2014 Huang
9,757,611 B1 * 9/2017 Colburn ..... A63B 22/0605
9,889,335 B2 2/2018 Palmer
10,195,483 B2 * 2/2019 Kaiser ..... A63B 22/0694
2004/0043874 A1 * 3/2004 Yang ..... A63B 21/153 482/72
2009/0149300 A1 * 6/2009 Chen ..... A63B 21/005 482/63

(Continued)

*Primary Examiner* — Joshua Lee
(74) *Attorney, Agent, or Firm* — Robert S. Smith

(57) ABSTRACT

A micro, compact cycling utility with an adjustable and modifiable structure that can perform as cycling or exercise equipment. The invention encompasses a housing that can be used as a case and/or attachment, crank arms, pedals and a stand. In the exemplary embodiment, the crank arms and pedals and stand are modifiable and adjustable.

4 Claims, 9 Drawing Sheets

(56) References Cited

U.S. PATENT DOCUMENTS

| | | | | |
|---|---|---|---|---|
| 2009/0192024 | A1 | 7/2009 | Wu | |
| 2011/0234175 | A1* | 9/2011 | Hajee | A63B 21/0053 320/164 |
| 2013/0237386 | A1 | 9/2013 | Tsai | |
| 2014/0256512 | A1* | 9/2014 | Kaiser | A63B 22/0694 482/9 |
| 2014/0287883 | A1* | 9/2014 | Decca | A63B 22/0694 482/57 |
| 2016/0303427 | A1* | 10/2016 | Kaiser | A63B 22/0694 |
| 2017/0246503 | A1* | 8/2017 | Palmer | A63B 21/16 |

* cited by examiner

PORTABLE COMPACT CYCLING TRAINER

CROSS-REFERENCE TO RELATED APPLICATIONS

This application relies on the priority of U.S. provisional patent application 62/523,501 filed by the present inventor on Jun. 22, 2017.

TECHNICAL FIELD

The present invention is generally directed to exercise equipment. More particularly, the present invention is directed to a stationary bicycle. Even more particularly, the present invention is directed to a compact, lightweight stationary cycling apparatus.

BACKGROUND OF THE INVENTION

People who travel often must endure sitting in a confined space, unable to move freely. This can result in problems with their legs. Tingling, stiffness, pain and even more serious problems including deep vein thrombosis and pulmonary embolism may occur. These problems can be greatly reduced by exercising the legs. Others desire to exercise their legs for the benefits of increased strength, improved muscle tone, improved circulation and improved general health.

Several different stationary bicycle trainer devices are currently available to allow users to exercise their legs. Most of them are designed with a heavy base to provide a stable, unmovable apparatus. U.S. Pat. No. 8,062,192B1 to Arstein describes a portable stationary bicycle trainer. However, its size and weight make it unsuitable for travel. In addition, people with a limited range of motion like the elderly or those undergoing physical therapy may have difficulty moving these devices from a position where they are being used to a position where they are stored for later use.

From the above, it is therefore seen that there exists a need in the art to overcome the deficiencies and limitations described herein and above.

Accordingly, it is an object of the present invention to provide an exercise stationary bicycle and, particularly to a compact, lightweight stationary cycling utility that can be easily transported due to its small size and light weight.

It is another object of the present invention to provide an exercise stationary bicycle that can be used by travelers, exercise enthusiasts, the elderly, patients with circulatory problems and anyone else wishing to exercise their legs.

It is yet another object of the present invention to provide apparatus that is very small and very portable.

It is a still further object of the present invention to can be quickly assembled or disassembled, allowing it to be stored or deployed with ease.

Yet another object is to provide apparatus having a sufficiently small size and light weight to allow it to be carried in a suitcase or placed in the overhead bin of an airplane.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all these objects are present as essential features, either individually or collectively, in the most general embodiment of the present invention or in any of its more specific embodiments.

SUMMARY OF THE INVENTION

The shortcomings of the prior art are overcome and additional advantages are provided through an exercise apparatus which includes a housing having 1st and 2nd spaced apart opposed sides, 1st and 2nd support bearings carried respectively by the 1st and 2nd spaced apart opposed walls in aligned coaxial relationship and an elongated shaft carried on the 1st and 2nd support bearings and releasably carrying 1st and 2nd arms extending from the elongated shaft radially from the shaft at axially spaced points along the axial extent of the shaft, in radial positions that are 180 degrees apart. The 1st and 2nd arms respectively carry 1st and 2nd pedals releasably connected thereto. The housing is dimensioned and configured for holding the elongated shaft, the 1st and 2nd arms and said 1st and 2nd pedals when you the pedals are released from the arms and the arms are released from the shaft.

In some forms of the apparatus the housing has a substantially parallelepiped shape.

The support bearings may have an axis thereof disposed substantially in a vertical plane that bisects the housing.

The apparatus may have 1st and 2nd sides that are substantially square and the support bearings have an axis thereof disposed substantially in the geometric center of the sides.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
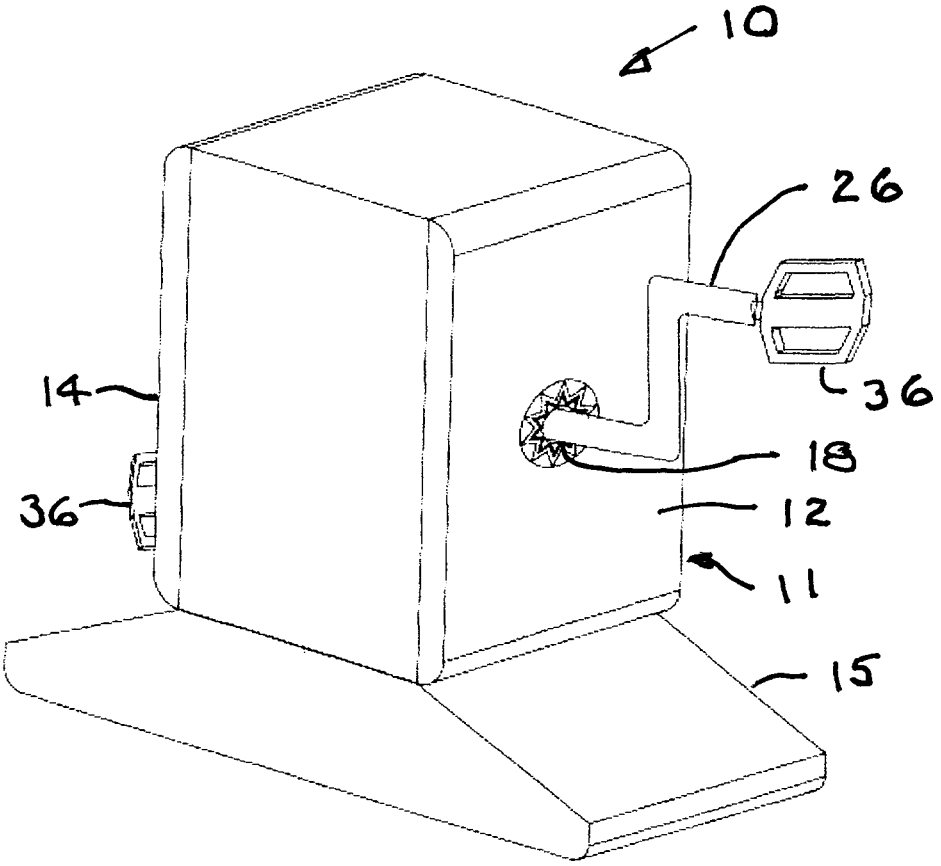
FIG. 1 is an isometric view of a fully assembled embodiment of the present invention.
Figure 2A:
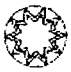
FIG. 2A is a top view of a washer that is part of the assembly shown in FIG. 1
Figure 2B:
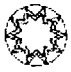
FIG. 2B is a top view of a washer that is part of the assembly shown in FIG. 1
Figure 2C:
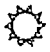
FIG. 2C is a top view of a washer that is part of the assembly shown in FIG. 1
Figure 2D:
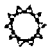
FIG. 2D is a top view of a washer that is part of the assembly shown in FIG. 1
Figure 2E:
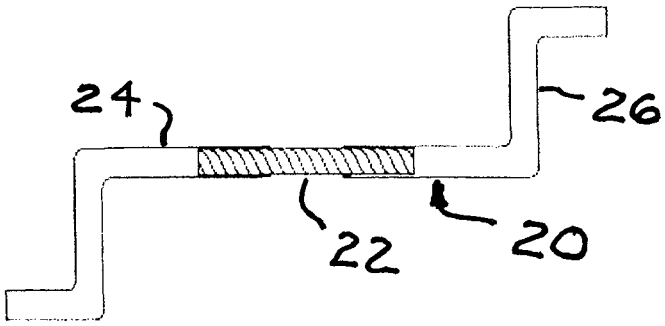
FIG. 2E is a side view of the crank arm assembly, having sleeve shaped protector and reinforcement axially extending over the rectilinear rod shaped portion thereof, that is part of the assembly shown in FIG. 1.
Figure 2F:
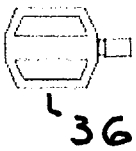
FIG. 2F is a top view of a pedal that is part of the assembly shown in FIG. 1.
Figure 2G:
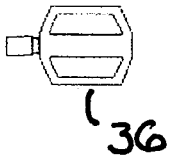
FIG. 2G is a top view of a pedal that is part of the assembly shown in FIG. 1.
Figure 2H:
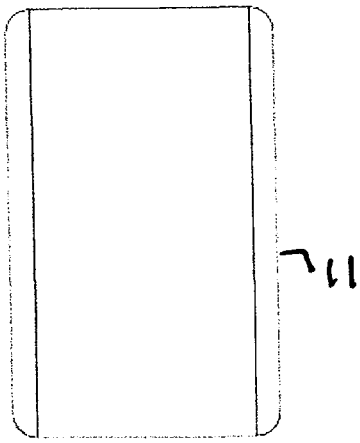
FIG. 2H is a side view of a housing that is part of the assembly shown in FIG. 1.
Figure 2I:
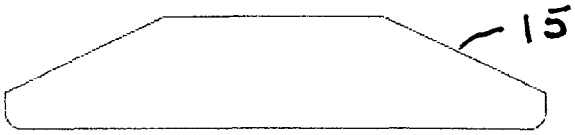
FIG. 2I is a side view of a stand that is part of the assembly shown in FIG. 1 and which provides stability for the assembly.
Figure 3:
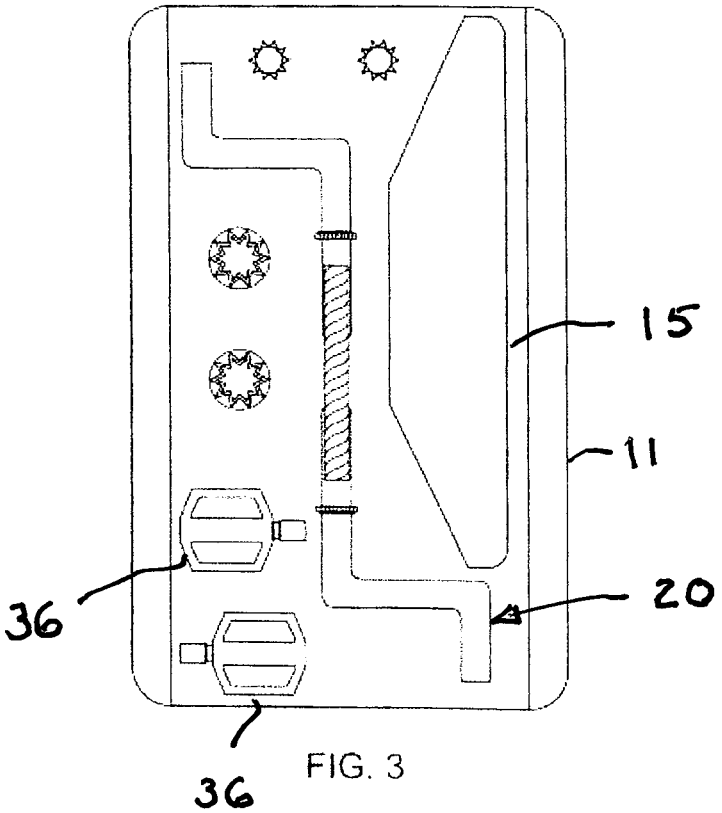
FIG. 3 is a top view of the disassembled parts of the apparatus disposed in the housing illustrating fit within the housing which facilitates transport and storage.
Figure 4:
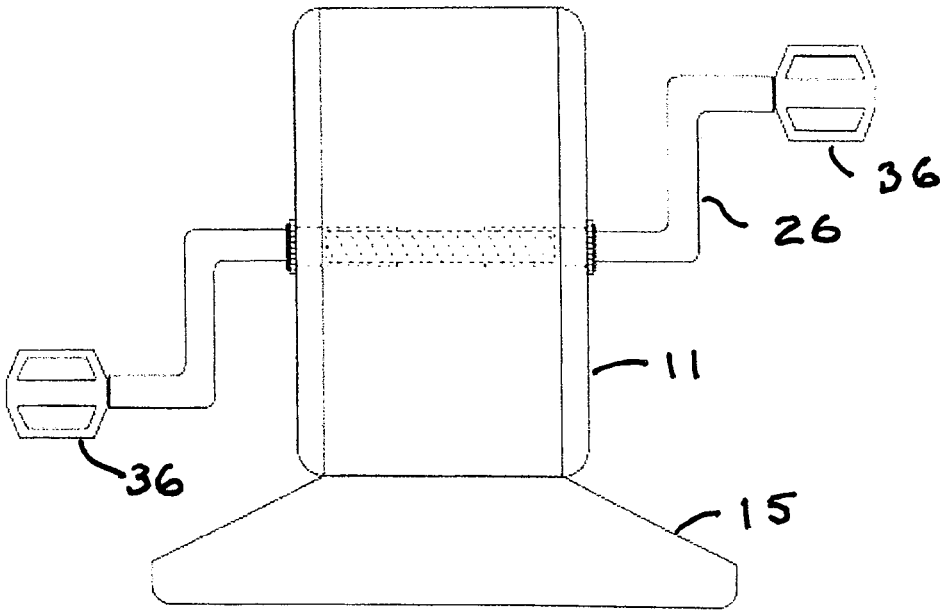
FIG. 4 is the front view of the apparatus shown in FIG. 1.
Figure 5:
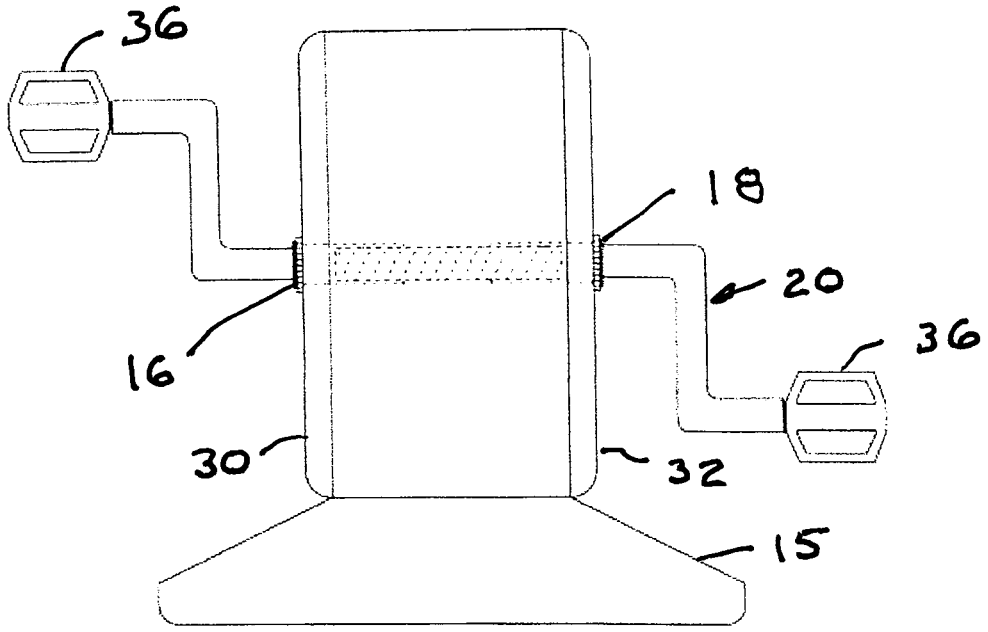
FIG. 5 is the back view of the apparatus shown in FIG. 1.
Figure 6:
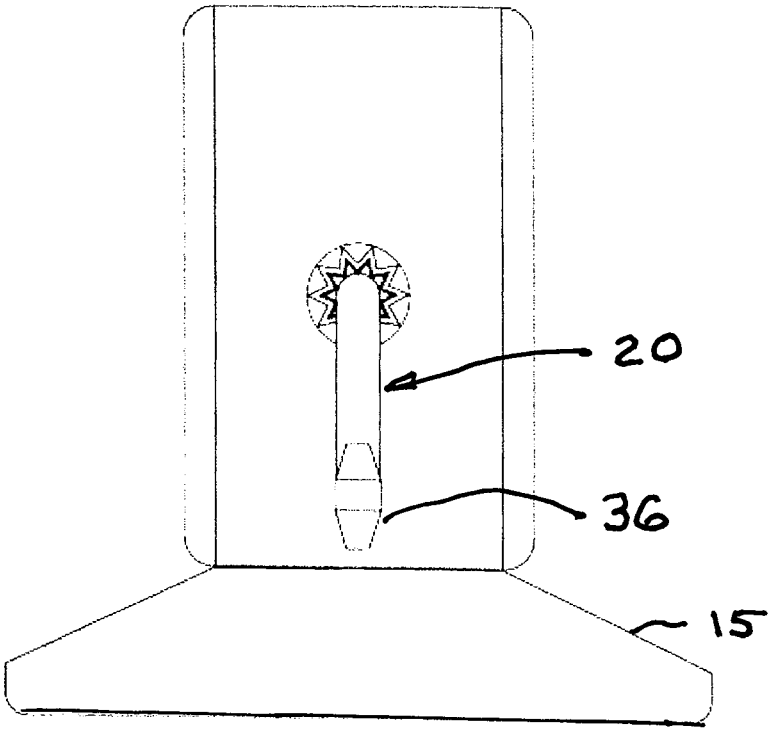
FIG. 6 is a left side view of the apparatus shown in FIG. 1.
Figure 7:
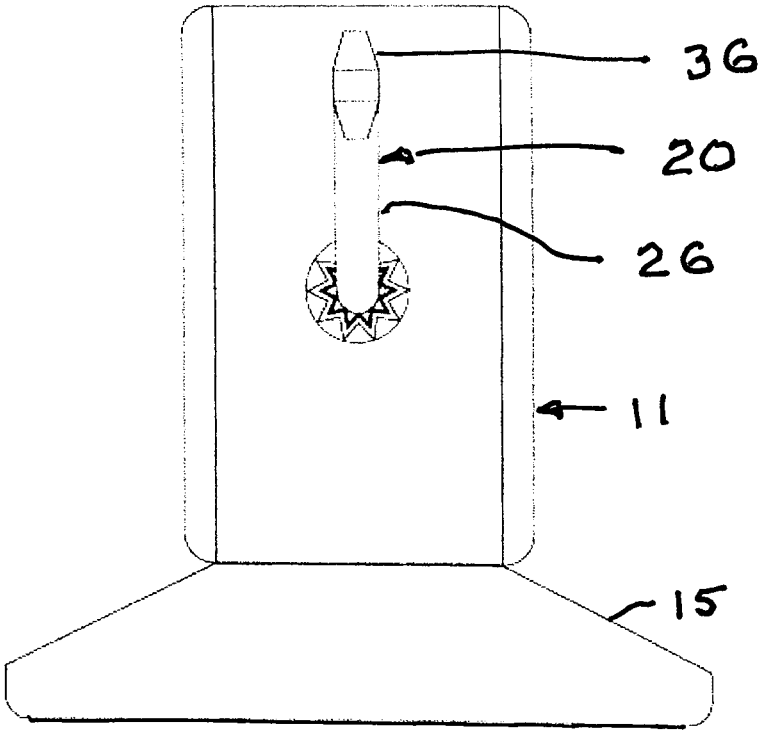
FIG. 7 is a right side view of the apparatus shown in FIG. 1.
Figure 8:
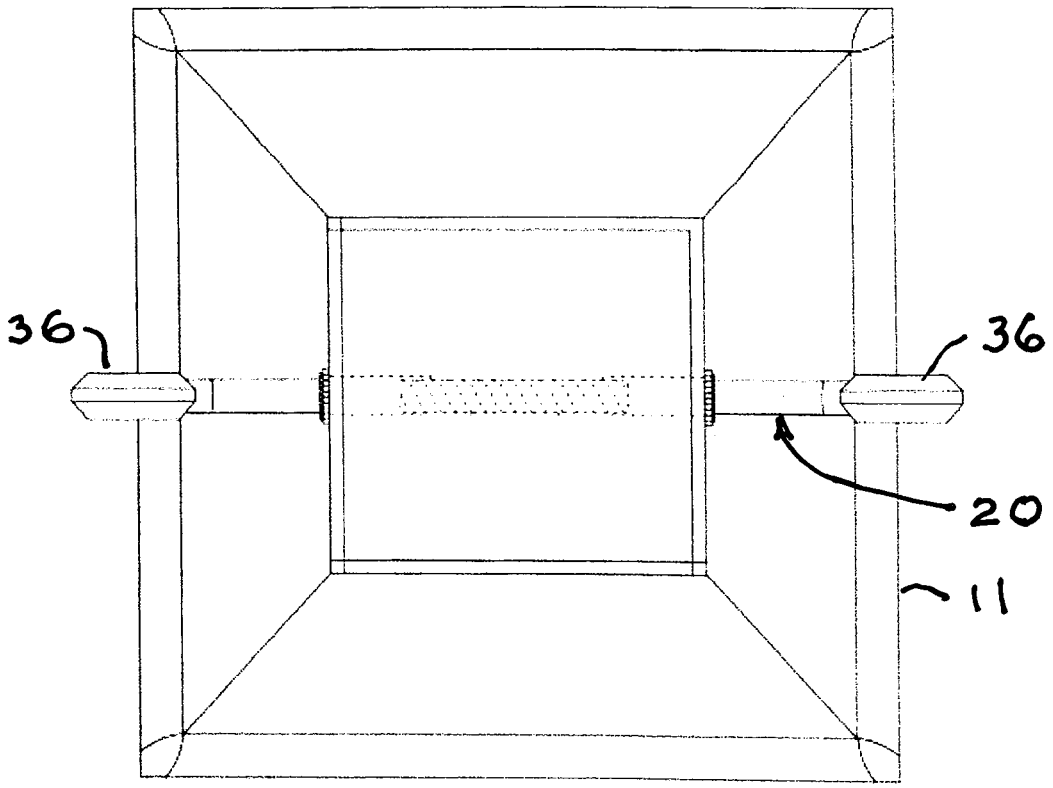
FIG. 8 is a bottom view of the housing shown in FIG. 1, illustrating the interior of the housing.
Figure 9:
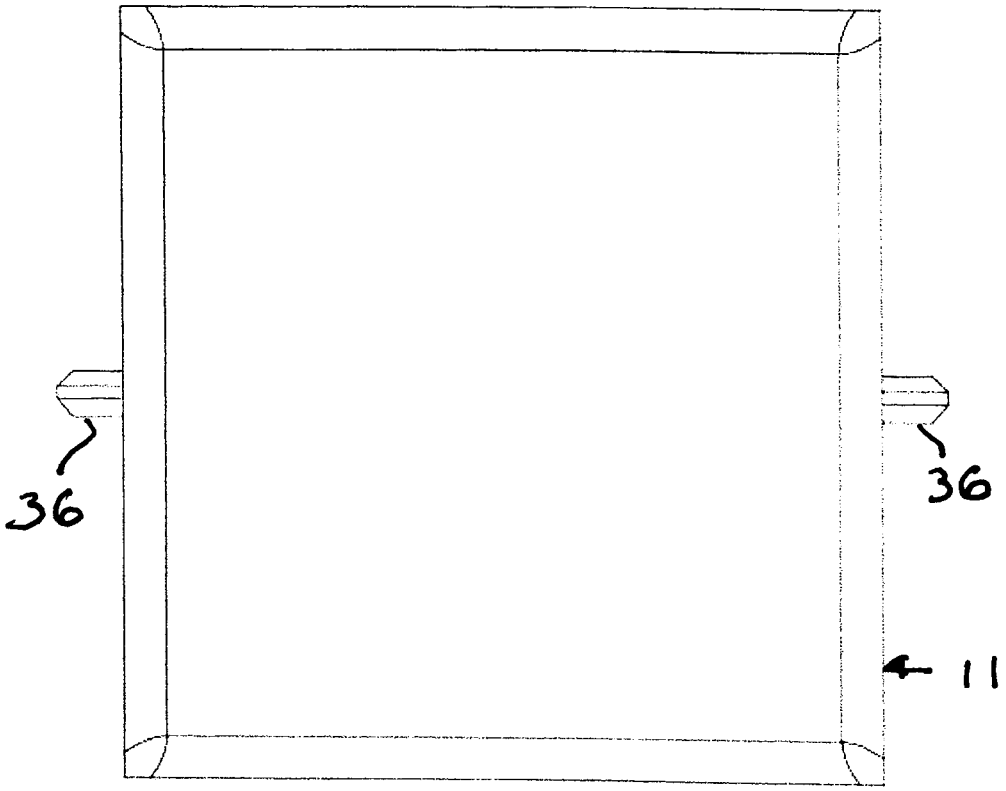
FIG. 9 is a top view of the apparatus shown in FIG. 1, with pedals visible on opposed sides of the housing.

The following detailed description is of the best currently contemplated mode of carrying out exemplary embodiments of the invention. The description is not to be taken in a limiting sense but is made merely for illustrating the general principles of the invention.

The fully assembled embodiment of the invention is comprised of a hollow substantially parallelepiped shaped housing 11 having opposed sidewalls 12, 14. The opposed sidewalls 12, 14 are provided respectively with 1st and $2^{nd}$ circular bearing holes 16, 18. The two bearing holes 16, 18 are coaxial and dimensioned and configured for receiving a rectilinear portion of the crank arm assembly 20. More particularly, a central sleeve 22 is concentrically disposed with respect to coaxial parts of each of the 1st and 2nd crank arms. The central sleeve 22 releasably engages the 1st and 2nd crank arms 24, 26. Respective thumbscrews (Not shown) in some cases fix the 1st and 2nd crank arms 24, 26 to the central sleeve 22. Those skilled in the art will recognize that separation of the central sleeve 22 from the respective crank arms 24, 26 is necessary to disassemble the apparatus 10 for storage. Similarly, those skilled in the art will recognize that fixing the central sleeve 22 to the respective crank arms 24, 26 is necessary for operation of the apparatus as in exercise device.

The housing 11 sits on a stand 15 that provides stability. First and second crank arms 24, 26 are attached to axial extremities of a rectilinear rod. First and second pedals 36 are respectively attached to the outboard part of the first and second crank arms 24, 26.

The exemplary embodiment of the present invention is polymeric plastic, but other embodiments may use metal. The bottom of the housing 11 affixes to a stand which stabilizes the device 10 while the device 10 is in use. The portion of the crank arm assembly 20 which resides inside the housing 11 when the device 10 is fully assembled is referred to here as the interior portion. The portion of the crank arm assembly 20 which resides outside the housing 11 is referred to as the exterior portion. The crank arms 24, 26 extend through the bearing holes 16, 18 in the opposed sides 30, 32 of the housing 11 and fixed together inside the housing 11 to form a single assembly.

In other embodiments the inboard extremities of the respective crank arms 24, 26 are not identical. More specifically, one crank has an inboard extremity that is a solid shaft and the other crank arm has an inboard axial extremity that is a hollow sleeve dimensioned and configured for concentric engagement with the solid shaft of the other crank arm. Some such embodiments of the present invention may provide a splined engagement between the 1st and 2nd crank arms. In a similar manner the embodiments using a sleeve to fix together two identical 1st and 2nd crank arms may also utilize a splined engagement to prevent relative rotation of one crank arm with respect to the other crank arm.

Still other embodiments of the present invention prevent relative rotational movement between the 1st and 2nd crank arms by using a polygon shaped coupling between the 1st and 2nd crank arms to lock the position of the arms relative to each other when torque is applied.

The exterior portions of the crank arms are cylindrical in shape in some embodiments. Other embodiments of the present invention may utilize a ball shaped locking detent to secure the crank arms 24, 26. The locking ball in such embodiments can be pressed to release a given crank arm. The exterior portions of the crank arms 24, 26 have a pedal 36 affixed to the end thereof which remains outside the housing 11. The pedals 36 freely rotate on their longitudinal axis to support normal cycling motion. When the current invention is being used, a user places his or her feet on the pedals 36 and moves his or her legs with a standard circular cycling motion.

The apparatus according to the present invention can be quickly disassembled for storage or for transport. The pedals 36 can be removed from the crank arms 26 by pressing the locking mechanism and pulling them apart. The locking mechanism may be a ball locking detent. Other embodiments of the invention may use a different locking mechanism. The crank arms 26 can be separated from each other by similarly pressing the lock mechanism and pulling them apart. The stand can be separated from the housing. The pedals, crank arms and stand will then fit inside the housing 11.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An exercise apparatus comprising:

a housing having first and second spaced apart opposed sides;

first and second support bearings carried respectively by said first and second spaced apart opposed sides in aligned coaxial relationship;

an elongated shaft carried on said first and second support bearings and releasably carrying first and second arms extending from said elongated shaft radially from said shaft at axially spaced points along the axial extent of said shaft, in radial positions that are 180 degrees apart;

said first and second arms releasably carrying first and second pedals;

said housing being dimensioned and configured for storing said elongated shaft, said first and second arms and said first and second pedals within the housing when said pedals are released from said arms and said arms are released from said shaft.

2. The apparatus as described in claim 1 wherein said housing is substantially a parallelepiped shape.

3. The apparatus as described in claim 1 wherein said support bearings have an axis thereof disposed substantially in a vertical plane that bisects said housing.

4. The apparatus as described in claim 1 wherein said first and second sides are substantially square and said support bearings have an axis thereof disposed substantially in the geometric center of said sides.

* * * * *